United States Patent [19]

Edwards

[11] Patent Number: 4,991,240

[45] Date of Patent: Feb. 12, 1991

[54] DISPOSABLE BATH

[76] Inventor: Vonnie M. Edwards, 1319 Fairwood Dr., Apt. 6G, Westland, Mich. 48185

[21] Appl. No.: 354,351

[22] Filed: May 19, 1989

[51] Int. Cl.[5] ..... A47K 3/024

[52] U.S. Cl. ..... 4/585

[58] Field of Search ..... 4/585, 587, 546, 547, 4/554, 558, 524, 526, 527, 529, 534, 547, 599, 573, 451, 452, 567, 568, 569, 619, 621, 590, 548, 588; 5/413, 494, 90, 463; 383/4, 41, 63; 128/365, 402, 400

[56] References Cited

U.S. PATENT DOCUMENTS

| | | | |
|---|---|---|---|
| 3,677,263 | 7/1972 | Allen | 128/365 |
| 4,055,863 | 11/1977 | Duval | 4/567 |
| 4,068,326 | 1/1978 | Deschler | 4/547 |

*Primary Examiner*—Henry J. Recla
*Assistant Examiner*—David J. Walczak
*Attorney, Agent, or Firm*—Basile and Hanlon

[57] ABSTRACT

A disposable bath in the form of a body having top and bottom walls and sealed side and end edges. The body is formed of a water impervious material with a soft inner liner. A main aperture is formed in the top wall of the body permitting access to an interior chamber in the body and is closable by a closure member. Preferably, the closure member is in the form of one or two flaps which are sealingly attachable to each other and to the body to sealingly close the main aperture. A second aperture to allow the head of a user to fit therethrough is also formed in the body. An elastic strip is mounted in the body about the second aperture to snugly conform the second aperture to the shape of a user's neck. An upstanding flange is mounted about the periphery of the second aperture to prevent fluid outflow from the interior of the body. An inlet is formed in the body to allow the supply of fluid into the interior chamber of the body and/or the discharge of fluid from the body.

10 Claims, 2 Drawing Sheets

DISPOSABLE BATH

BACKGROUND OF THE INVENTION

1. Field of the Invention

This invention relates, in general, to bathing devices and, more specifically, to bathing devices for hospitalized or invalid patients.

2. Description of Relevant Art

It is common for people confined to a bed to be given a bath while laying in a prone position on the bed. Such a need occurs frequently in hospitals and with invalid people requiring long term care.

While "sponge baths" are typically given to such people, such baths do not generally provide a thorough cleaning as does a bath where a large portion of the person's body is immersed in water. Such immersion also has comforting as well as therapeutic effects.

Various devices have been designed to enable a person confined to a bed to take or be given a bath while laying on the bed in a prone position. The available bed baths ae formed of a number of separate interconnected parts or elements and require some assembly or erection on the bed. This is time consuming and, in some instances, may be difficult since the person is laying on the bed.

Thus, it is desirable to provide a bath which is usable on a bed or other flat surface to immerse a person in water. It is also desirable to provide a bath which is formed of a small number of separate parts resulting in a low manufacturing cost for easy disposal after a single use. It would also be desirable to provide a bath which may be folded into a small compact package for storage and transport. Finally, it would be desirable to provide a bath which requires only a minimum amount of assembly or erection on a bed.

SUMMARY OF THE INVENTION

The present invention is a disposable bath particularly suited for use on a bed or other flat surface. The disposable bath is in the form of a body having a top and bottom walls and sealed side and end edges. The body is formed of a layer of water impervious material and has a soft, inner liner.

A main aperture is formed in the top wall of the body and permits access to an interior chamber in the body formed between the top and bottom walls and the sealed side and end edges. A closure means is mounted on the body for closing the main aperture in the top wall of the body. In a preferred embodiment, the closure means comprises at least one, and preferably two, flaps mounted to the top wall and disposable in overlaying relationship over the main aperture in the body. In another embodiment, the overlapping edges of two flaps are provided with interlocking seal means to sealingly close the main aperture.

A second aperture is also formed in the top wall of the body, spaced from the main aperture, for receiving the head of a user of the disposable bath. An elastic strip is mounted in the body around th eperipheral edge of the second aperture to snugly conform the second aperture to the shape of the user's head. An upstanding collar is joined about the periphery of the second aperture to prevent the egress fluid from the interior chamber in the body through the second aperture.

An inlet is formed in the body to allow the flow of fluid into the interior chamber of the body and/or the discharge of fluid from the body. In a preferred embodiment, separate inlets and outlets are mounted in the body to enable the input and discharge of fluid to and from the body, respectively.

In another embodiment, a removable support frame is mountable within the interior chamber of the body to space the top wall from the bottom wall of the body when the disposable bath is in use. The support frame is in the form of a plurality of post members having an elongated flexible line or cord extending therebetween.

The disposable bath of the present invention overcomes many of the deficiencies found in previously available bed baths. The disposable bath of the present invention is simple and inexpensive in construction which leads to economic disposal after a single use. The flat configuration of the present disposable bath enables it to be folded into a small compact shape for easy storage and transport before use.

When using the disposable bath of the present invention, the bath is simply expanded on the bed thereby requiring no complicated assembly or erection procedures. Finally, the disposable bath of the present invention enables a person confined to a bed to be given a bath by immersion in water for comfort, thorough cleaning and/or for therapeutic effects.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Throughout the following description and drawing, an identical reference number is used to refer to the same component shown in multiple figures of the drawings.

Figure 1:
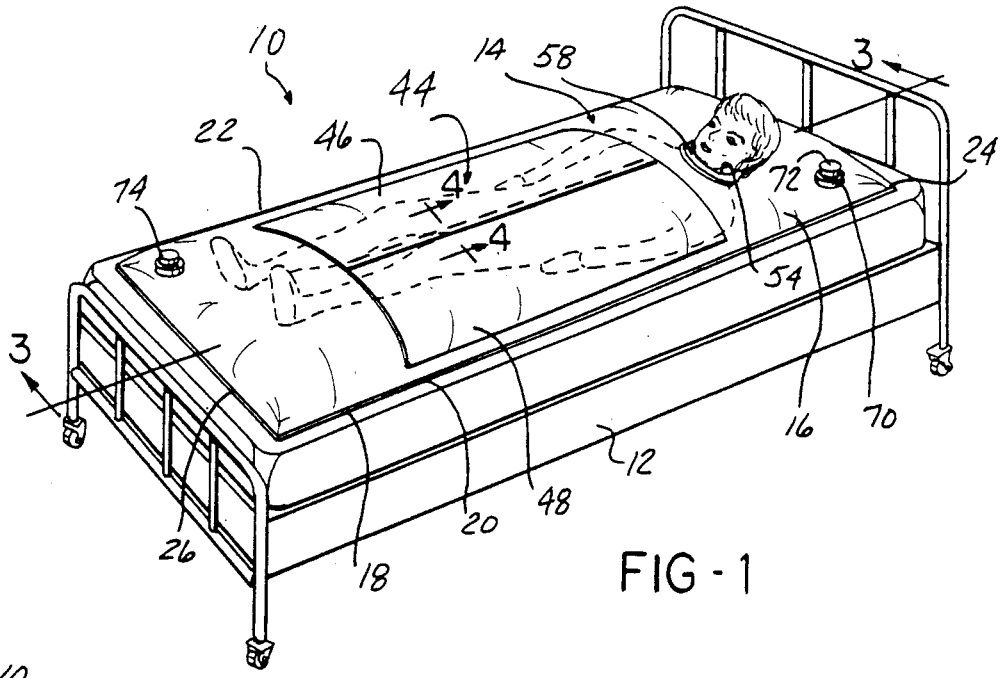
FIG. 1 is a perspective view of the disposable bath of the present invention shown in a deployed position on a conventional bed.
Figure 2:
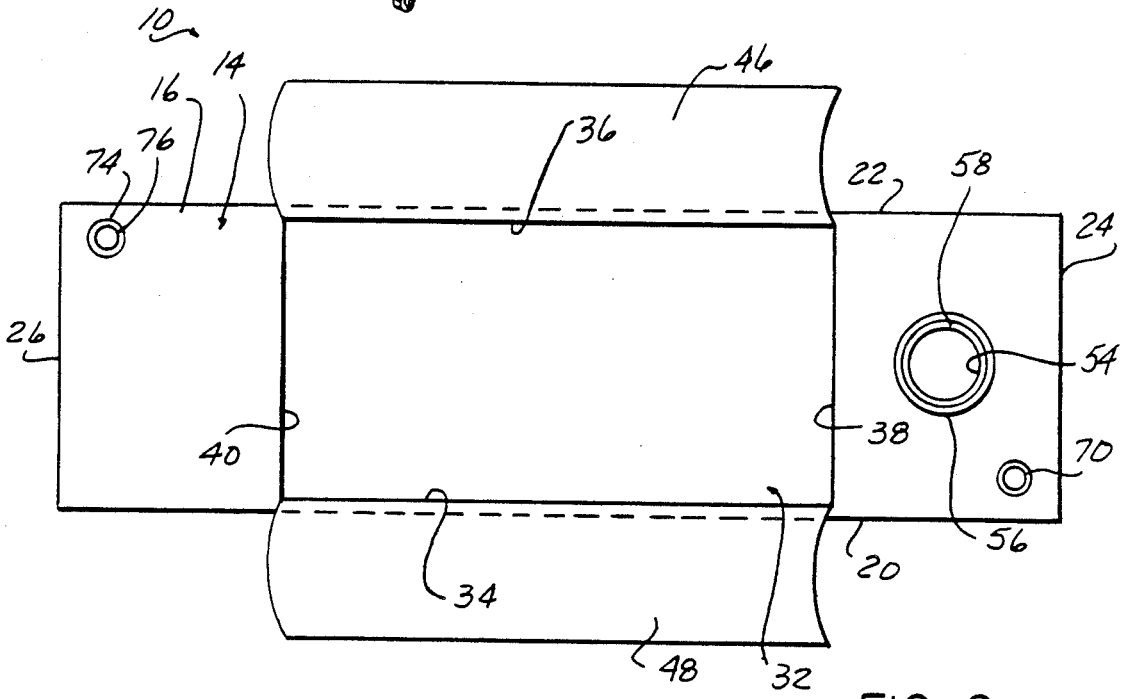
FIG. 2 is a plan view of the disposable bath shown in its opened, deployed position.
Figure 3:
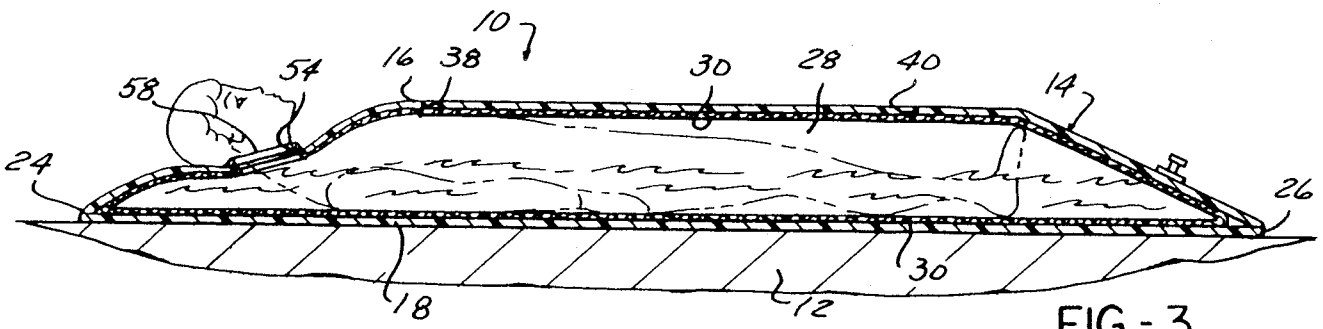
FIG. 3 is a cross sectional view generally taken along line 3—3 in FIG. 1.

Referring now to the drawing, and to FIGS. 1, 2 and 3 in particular, there is illustrated a disposable bath 10 particularly suited for use in bathing a person laying in a prone position on a bed 12, such as a conventional hospital bed.

The disposable bath 10 is in the form of a body denoted in general by reference number 14 which is formed of a top wall 16 of generally planar configuaration and a bottom wall 18 also of planar configuration.

Preferably, the top and bottom walls 16 and 18, respectively, are formed of a water impervious material, such as any suitable plastic. The top and bottom walls 16 and 18 may have any desired configuration to receive in a surrounding manner a human body. Although a generally rectangular configuration is illustrated in FIG. 1 for the body 14, it will be understood that other shapes may also be employed.

Each of the top and bottom walls 16 and 18 are formed with sealed side edges 20 and 22 and sealed end edges 24 and 26. The side edges 20 and 22 and the end edges 24 and 26 may be joined together by any suitable means, such as by an adhesive or by heat sealing. This forms a hollow interior chamber 28 between the top and bottom walls 16 and 18 and the sealed side edges 20 and 22 and the sealed end edges 24 and 26 which is configured to receive the body of a user as shown in FIG. 1.

For comfort, an inner layer 30 of a soft material, such as a fabric, i.e., cotton. The inner layer 30 is attached to the top and bottom walls 16 and 18 and extends along the entire surface bounding the interior cavity 28.

The generally planar configuration of the top and bottom walls 16 and 18 provides a flat configuration for the body 14 which enables the body 14 to be folded into a small compact form for ease of storage and transport prior to actual use. When being used, the body 14 is merely unfolded to the shape shown in FIG. 1 for receiving the body of a user as described in greater detail hereafter.

A main aperture denoted by reference number 32 is formed in the top wall 16 of the body 14. The aperture 32 is sized to enable easy ingress of the body of a user into the interior chamber 28 of the body 14 of the disposable bath 10. The main aperture 32 has a generally rectangular configuration formed of opposide side walls 34 and 36 and opposed end walls 38 and 40. The side walls 34 and 36 are respectively spaced from the side edges 20 and 22, respectively, of the body 14. Likewise, the ends 38 and 40 of the aperture 32 are spaced from the sealed end edges 24 and 26 of the body 14.

Closure means denoted in general by reference number 44 is mounted on the body 14 and removably opens and closes the main aperture 32 in the body 14. In a preferred embodiment, the closure means 44 comprises at least one and preferably two flap members 46 and 48. The flaps 46 and 48 are joined along one edge to the top wall 16 of the body 14 adjacent the side edges 36 and 34, respectively, bounding the aperture 32. The flaps 46 and 48 are disposable in overlapping arrangement as shown in FIG. 1 to completely cover the aperture 32 and seal and retain fluid within the interior chamber 28 within the body 14.

Figure 4:
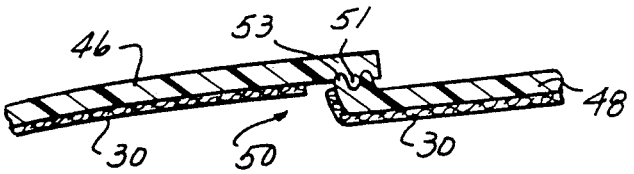
FIG. 4 is a partial, sectional view generally taken along line 4—4 in FIG. 1.

In one embodiment, as shown in FIG. 4, the closure means 44 includes seal means denoted by reference number 50. The seal means 50 is preferably disposed on the overlapping edges of the flaps 46 and 48 or, if only a single large flap is employed, on the movable edge of the single flap and the portion of the top wall 16 of the body 14 which contacts the movable edge of the single large flap. Any suitable sealing means 50 may be employed to sealingly join the overlapping edges of the flaps 46 and 48 together. As shown in FIG. 4, interlocking tongue 51 and grooves 53 ae mounted on the edges of the flaps 46 and 48 and sealingly lock together along the length of the flaps 46 and 48 to sealingly close the aperture 32 in the body 14.

Figure 5:
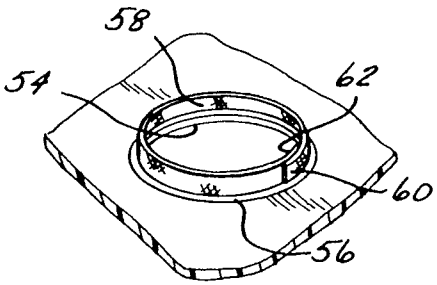
FIG. 5 is a partial, enlarged view showing the construction of the second aperture in the disposable bath of the present invention.

A second aperture 54 is formed in the top wall 16 of the body 14 between the sealed end edge 24 and the edge 38 of a first or main aperture 32, as shown in FIGS. 1, 2 and 5. The second aperture 54 has a generally circular shape to conform to the shape of the neck of a user of the disposable bath 10. A thin strip of elastic 56 is joined to the top wall 16 about the periphery of the aperture 54 to enable the shape of the aperture 54 to snugly conform to the shape of the neck of the user of the disposable bath 10.

In addition, a flange 58 having substantially the same shape as the aperture 54 is joined to the top wall 16 about the periphery of the aperture 54. The flange 58 is provided with first and second opposed ends 60 and 62, respectively, which are disposable in an overlapping, mating arrangement as shown in FIG. 5. Conventional connecting means, such as mating Velcro fasteners, not shown, are joined to the opposed faces of the first and second ends 60 and 62 of the flange 58 to enable the circumference of lenght of the flange 58 to be varied to provide a snug fit about the neck of a user and to prevent the egress of fluid from the interior chamber 28 of the disposable bath 10.

Figure 8:
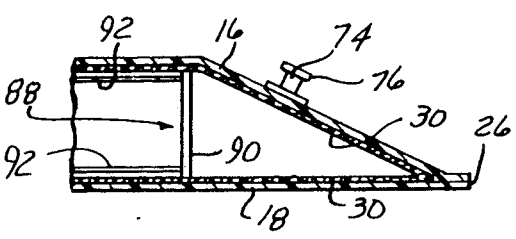
FIG. 8 is a partial, sectional view showing a portion of the support frame depicted in FIG. 7.
Figure 6:
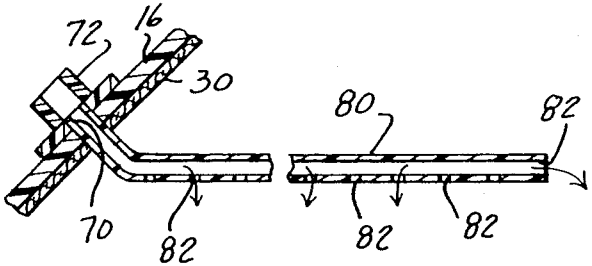
FIG. 6 is a partial, sectional view of another embodiment of the present invention depicting the use of a spray conduit.

As shown in FIGS. 1 and 2 and in greater detail in FIGS. 6 and 8, an inlet 70 is formed in the top wall 16 adjacent one end 24 of the disposable bath 10. The inlet 70 has a connector 72 mounted thereover to provide a connection to a source of fluid. The inlet 70 is disposed in fluid flow communication with the interior chamber 28 to allow the supply of fluid to the interior chamber 28 to immerse a user disposed within the disposable bath 10. The inlet 70 may also be employed to discharge fluid from the interior chamber 28 after use of the disposable bath has been completed.

Alternately, an outlet connector 74 closeable by a removable cap 76 may be mounted on the top wall 16 of the disposable bath 10 adjacent one 26 end of the disposable bath 10. The outlet 74 enables fluid within the interior chamber 28 to be discharged from the disposable bath 10.

In another embodiment shown in FIG. 6, an elongated conduit or tube 80 is permanently or removably attached to the inlet 70. The hollow conduit 80 is provided with at least one and preferably a plurality of openings 82 at one end or along its length to allow fluid to flow therethrough. The spray conduit or tube 80 enables liquid supplied to the inlet 70 to be discharged in a controlled manner, such as over the body of the user within the disposable bath 10, to provide a more thorough cleaning of the user's body.

Figure 7:
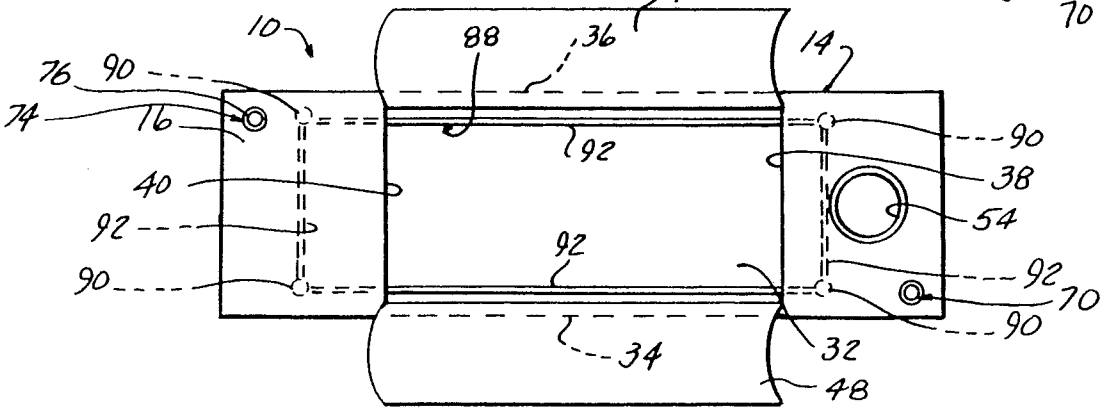
FIG. 7 is a partial, plan view showing the mounting of the support frame of another embodiment of the present invention in the disposable bath.

As shown in FIGS. 7 and 8, a support frame denoted in general by reference number 88 is removably disposable within the interior chamber 28 to space the top wall 16 from the bottom wall 18 to enable fluid to be more easily supplied to the interior chamber 28 and to enable the fluid to completely surround and immerse the body of a user disposed within the disposable bath 10. The support frame 88 includes a plurality of vertically positionable posts 90 of generally cylindrical form which may be arranged in a square pattern as shown in FIG. 7. An elongated cord or wire 92 extends outward from each post 90 to the other posts to form the support frame 88. The posts 90 and cords 92 prevent the top wall 16 from sagging about the user's body so as to provide a more even distribution of fluid within the interior chamber 28 and to aid in filling the interior chamber 28 with fluid through the inlet 70.

In use, the disposable bath 10 will generally be in a compact folded position. The intended user of the bath 10 located on the bed 12 will be rolled to one side of the bed 12 and the folded disposable bath 10 positioned on the opposite unused side of the bed 12. The bath 10 is then partially unfolded along its longitudinal axis and one of the flaps, such as flap 46 opened to allow access to the interior chamber 28 within the body 14. The user is then moved into The interior chamber 28 and the remaining unfolded portion of the disposable bath 10 opened until the bath 10 is deployed in its expanded form as shown in FIGS. 1 and 2. The user's feet may then be disposed beneath one end portion of the wall 16 is adjacent the end 26 of the body 14 underneath the top wall 16. The opposite end portion of the top wall 16 adjacent end edge 24 is then raised until the user's head is fitted through the second aperture 54. The elastic band 56 surrounding the second aperture 54 snugly conforms the aperture 54 to the shape of the user's neck. Additional snugness may be provided by adjusting the length of the flange 58 until the second aperture 54 is completely closed about the user's neck.

Fluid, such as water, may then be supplied to the bath 10 by connecting a hose attached to a water faucet to the inlet connector 72 and the inlet 70. Water is supplied to the interior chamber 28 in a sufficient quantity until the user's body is completely surrounded by and at least partially immersed by water as shown in FIG 3. The flaps 46 and 48 are closed and sealed if the sealing means 50 is provided to sealingly close the aperture 32 in the top wall 16.

Upon completion of bathing, the outlet 74 is opened to allow the fluid to be discharged from interior chamber 28. When the fluid is completely discharged, the user is removed from the disposable bath 10 by reversing the order of steps described above and the bath 10 is removed from the bed and discarded.

In summary, there has been disclosed a unique disposable bath particularly suited for use by persons confined to a bed. The bath is of simple form with a low manufacturng cost to enable easy and economical disposal after a single use and, further, may be folded into a compact form for ease of storage and transport prior to use. The disposable bath of the present invention enables a user to be immersed in water while laying in a prone position on a bed for thorough cleaning and/or for comfort or therapeutic effects. Finally, the disposable bath of the present invention, due to its simplified construction, requires a minimum of assembly to deploy it on a bed.

What is claimed is:

1. A disposable bath comprising:

a body formed of a water impervious, flexible material having separable planar top and bottom walls, and sealed side and end edges defining a flat, expandable hollow interior chamber;

a main aperture formed in the top wall of the body permitting access to the interior chamber in the body;

closure means mounted on the body for closing the main aperture in the top wall of the body;

a second aperture formed in the top wall of the body and spaced from the main aperture; and inlet means, formed in the body in fluid flow communication with the interior chamber in the body, for connecting a fluid supply to the interior chamber in the body for supplying fluid to and emptying fluid from the interior chamber; a support frame formed of a plurality of posts removably disposable in a spaced relationship within the interior chamber in the body between the top and bottom walls; and line means, connected to and extending between the posts for retaining the posts in a vertical orientation in the body.

2. The disposable bath of claim 1 wherein the closure means comprises:

a flap mounted on the body and movably disposable over the main aperture.

3. The disposable bath of claim 1 wherein the closure means comprises:

first and second flaps mounted on the body and opposite sides of the main aperture and movably disposable in overlapping relationship over the main aperture.

4. This disposable bath of claim 1 wherein the closure means further includes:

seal means for sealingly attaching the closure means to the body over the main aperture.

5. The disposable bath of claim 4 wherein the seal means comprises:

mating tongue and groove formed on the closure means and the body.

6. The disposable bath of claim 1 further including:

an expandable strip means mounted on the body around at least a portion of periphery of the the second aperture for expanding the size of the second aperture.

7. The disposable bath of claim 1 further including:

an upstanding flange mounted on the body about the periphery of the second aperture and extending outward from the top wall of the body.

8. The disposable bath of claim 7 wherein:

the flange includes first and second ends; and mating connector means, mounted on the first and second ends of the flange, for adjustably connecting the first and second ends together.

9. The disposable bath of claim 1 further including:

an elongated spray tube having at least one outlet aperture, the spray tube connected at one end to the inlet and disposable within the interior chamber for spraying fluid into the interior chamber.

10. The disposable bath of claim 1 wherein the inlet means comprises:

a separate outlet formed in the body in fluid flow communication with the interior chamber for discharging fluid from the interior chamber.

* * * * *